US006022238A

United States Patent [19]

Tomita et al.

[11] Patent Number: 6,022,238

[45] Date of Patent: Feb. 8, 2000

[54] DOUBLE LOCK FOR CONNECTOR

[75] Inventors: Yoshinori Tomita; Naomi Suzuki, both of Shizuoka, Japan

[73] Assignee: Yazaki Corporation, Tokyo, Japan

[21] Appl. No.: 08/984,334

[22] Filed: Dec. 3, 1997

[30] Foreign Application Priority Data

Jan. 16, 1997 [JP] Japan ..... 9-005632

[51] Int. Cl.[7] ..... H01R 13/627

[52] U.S. Cl. ..... 439/352; 439/489

[58] Field of Search ..... 439/488, 489, 439/352–358

[56] References Cited

U.S. PATENT DOCUMENTS

| | | |
|---|---|---|
| 4,946,395 | 8/1990 | Cope et al. . |
| 4,946,404 | 8/1990 | Takenouchi et al. . |
| 5,120,255 | 6/1992 | Kouda et al. . |
| 5,203,718 | 4/1993 | Chishima . |

FOREIGN PATENT DOCUMENTS

| | | | |
|---|---|---|---|
| 0 449 239 | 10/1991 | European Pat. Off. . | |
| 3-285280 | 12/1991 | Japan | H01R 13/64 |
| 5-61970 | 8/1993 | Japan | H01R 13/42 |

OTHER PUBLICATIONS

European Search Report dated Apr. 22, 1999.
European Search Report dated Jan. 7, 1991.

*Primary Examiner*—Khiem Nguyen
*Attorney, Agent, or Firm*—Sughrue, Mion, Zinn, Macpeak & Seas, PLLC

[57] ABSTRACT

A pair of guide grooves (33) disposed on a double lock member (30) allow a pair of guide ribs (14) disposed on a female connector housing (11) to be inserted thereinto, respectively, at the time of engaging the double lock member (30) with the female connector housing (11). Accordingly, the pair of guide grooves (33) guides the double lock member (30) in such a manner that the double lock member (30) can take a predetermined position with respect to the female connector housing (11). The guide grooves (33) are formed so as to enclose substantially all the outer surfaces of the guide ribs (14) with inner sidewalls (34) and outer sidewalls (35) thereof, respectively. In addition, a distance (C) between outer side surfaces of the respective guide ribs (14) is set to a value equal to or greater than a distance (D) between inner surfaces of the outer sidewalls (35) of the respective guide grooves (33).

8 Claims, 5 Drawing Sheets

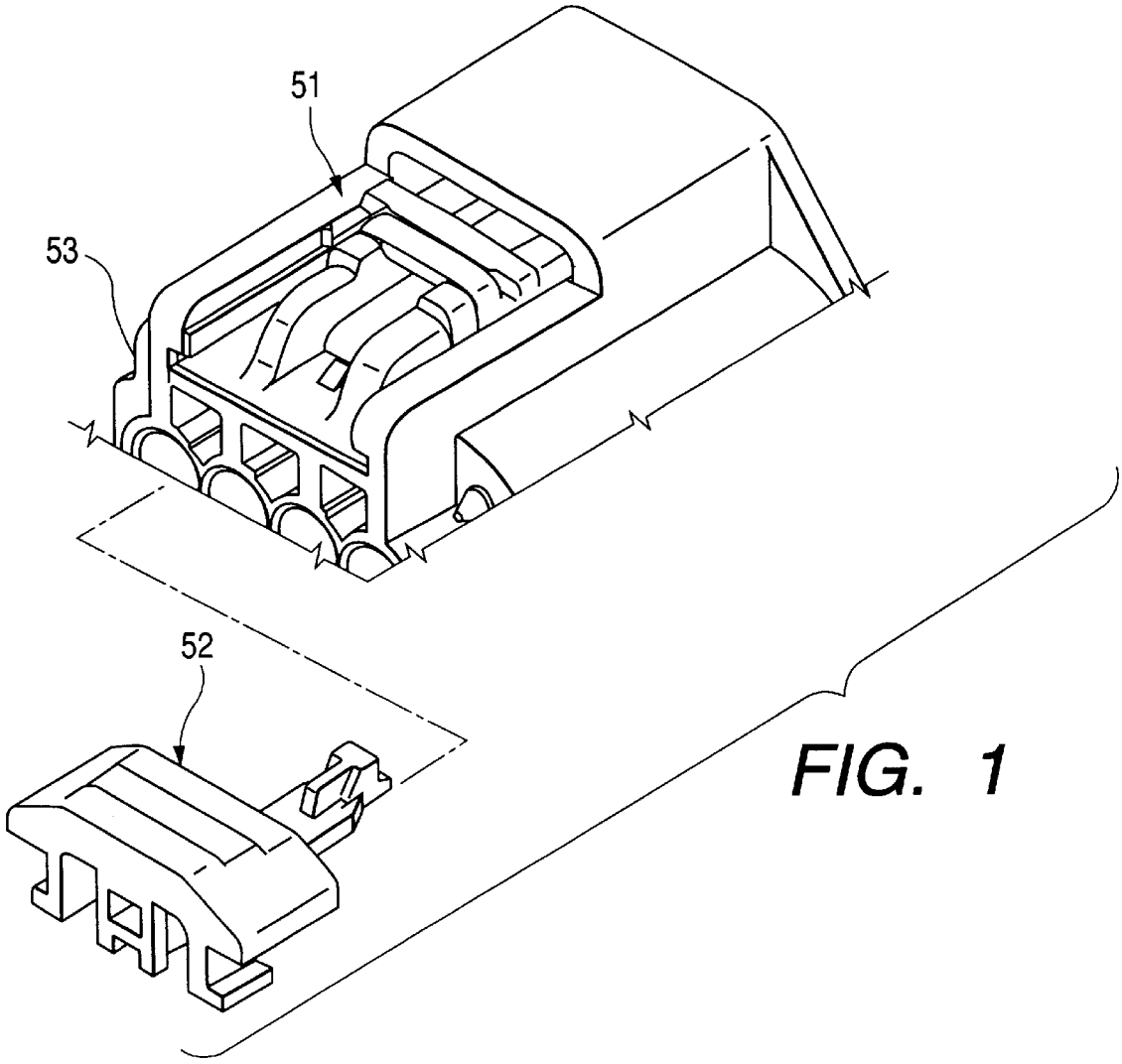
FIG. 1
FIG. 2
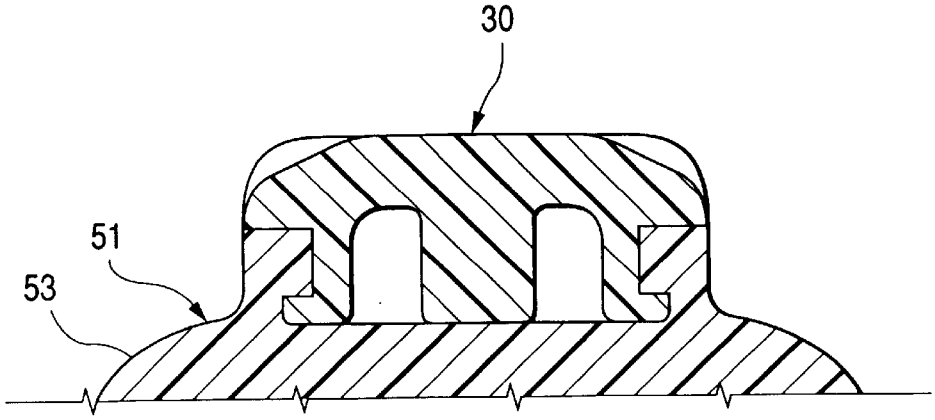

DOUBLE LOCK FOR CONNECTOR

BACKGROUND OF THE INVENTION

This invention relates to a double lock for connectors that is designed to hold engagement between a male connector and a female connector.

A conventional double lock for connectors includes a double lock member which is temporarily retained with a connector housing, and is regularly retained with the connector housing so as to hold an engagement between the connectors.

SUMMARY OF THE INVENTION

The object of the invention is to provide a double lock for connectors that can reliably prevent a double lock member from playing, etc., and ensure satisfactory operability during the double lock member assembling operation. According to the double lock of the invention, it is possible to prevent noise or the like from being made after double-locked connectors that have been assembled to a motor vehicle, and further, it is possible to achieve a cost reduction.

The above object of this invention has been achieved by a double lock for connectors that includes: a double lock member temporarily retained while engaged with a female connector in a predetermined direction, and regularly retained with the female connector in a condition such that a male connector is engaged with the female connector, so that the double lock member holds the engagement between the male connector and the female connector; a pair of guide ribs disposed on the female connector so as to extend along an engagement direction of the double lock member and so as to be apart from each other by a predetermined distance in a direction intersecting to the engagement direction; and a pair of guide grooves disposed on the double lock member so as to extend along a direction of engaging the double lock member with the female connector and so as to be apart from each other by a predetermined distance in a direction intersecting to the engagement direction, and allowing the corresponding guide ribs to be inserted thereinto at the time of engaging the double lock member with the female connector, so that the pair of guide grooves guide the double lock member in such a manner that the double lock member can take a predetermined position with respect to the female connector.

It is preferred that the guide grooves enclose substantially all the outer surfaces of the guide ribs at the time of allowing the corresponding guide ribs to be inserted thereinto, respectively.

A distance between the respective guide grooves and a distance between the respective guide ribs are set so that the distance between the guide ribs is equal to or greater than the distance between the guide grooves. When the respective guide grooves allow the corresponding guide ribs to be inserted thereinto, it is preferred that predetermined portions of the guide grooves are fitted with the corresponding portions of the guide ribs, respectively, so that predetermined biasing forces to be applied to each other are caused.

It is preferred that projections be disposed on the predetermined portions of the guide grooves, respectively.

In the double lock for connectors of the invention, the double lock member is temporarily retained with the female connector while engaged with the female connector in a predetermined direction, and regularly retained with the female connector in the condition such that the male connector is engaged with the female connector, so that the double lock member holds the engagement of the male connector and the female connector.

At the time of engaging the double lock member with the female connector, the pair of guide grooves disposed on the double lock member allow the pair of guide ribs disposed on the female connector to be inserted thereinto, respectively. Accordingly, the guide grooves guide the double lock member in such a manner that the double lock member can take a predetermined position with respect to the female connector. The guide grooves enclose substantially all the outer surfaces of the guide ribs at the time of allowing the corresponding guide ribs to be inserted thereinto, respectively.

BRIEF DESCRIPTION OF THE DRAWINGS

FIG. 1 is a perspective view showing a double lock for connectors of a preliminary embodiment for the invention;

FIG. 2 is a sectional view partially showing a double lock member and a female connector housing of the double lock for connectors of FIG. 1;

DETAILED DESCRIPTION OF THE PREFERRED EMBODIMENTS

Preliminary Embodiment

A preliminary embodiment for the invention will now be illustrated with reference to FIGS. 1 to 4. A double lock for connectors as shown in FIGS. 1 to 4 includes a double lock member 52 holding engagement between a male connector 50 and a female connector 51. The double lock member 52 is temporarily retained with a female connector housing 53 of the female connector 51 while engaged with the female connector housing 53 in a predetermined direction. Furthermore, the double lock member 52 is regularly retained with the female connector housing 53 in a condition such that the male connector 50 is engaged with the female connector 51, so that the double lock member 52 holds the engagement between the male connector 50 and the female connector 51.

The aforementioned double lock for connectors may have the following three possibilities because the double lock member 52 may be subjected to a large play or the like within dimensional tolerance or the like particularly when the area of contact between the double lock member 52 and the female connector housing 53 is small.

Figure 3:
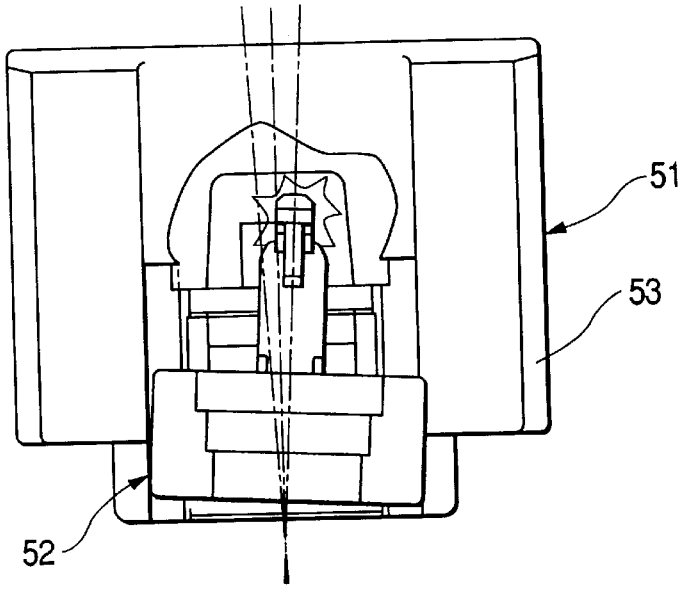
FIG. 3 is a plan view showing a condition in which the double lock member of the double lock for connectors of FIG. 1 is temporarily retained obliquely with respect to the female connector housing.

1) As shown in FIG. 3, when the double lock member 52 is inserted to be temporarily retained with the female connector housing 53, there is a possibility such that the double lock member 52 is positioned obliquely with respect to the female connector housing 53. Excessive force may be applied locally onto the female connector housing 53 to cause a deformation of the double lock member 52 due to the oblique posture of the double lock member 52. Furthermore, the double lock member 52 may be regularly retained with the female and the male connectors unengaged with each other.

Figure 4:
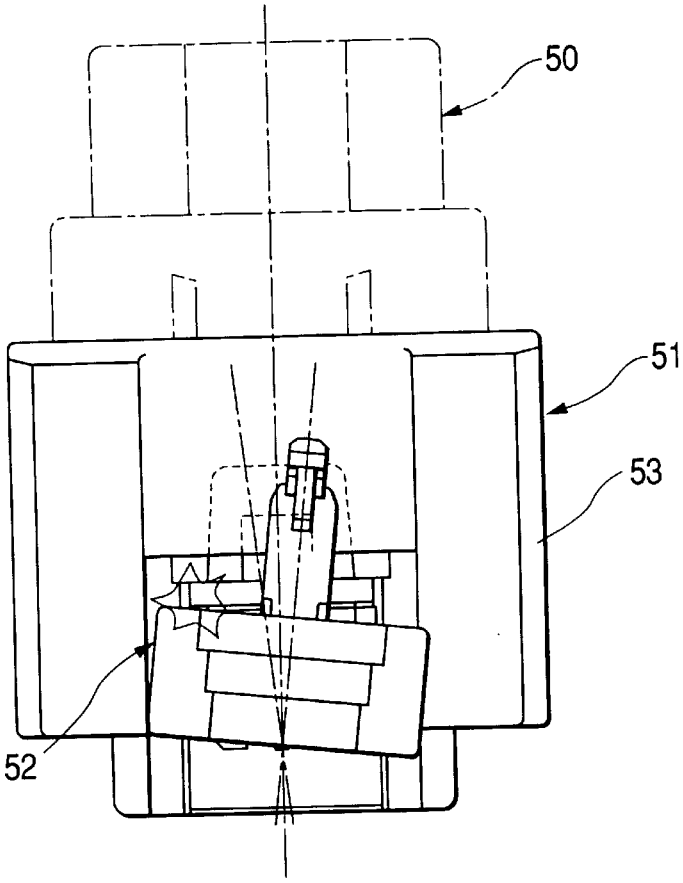
FIG. 4 is a plan view showing a condition in which the double lock member of the double lock for connectors of FIG. 1 is regularly retained obliquely with respect to the female connector housing.
Figure 5:
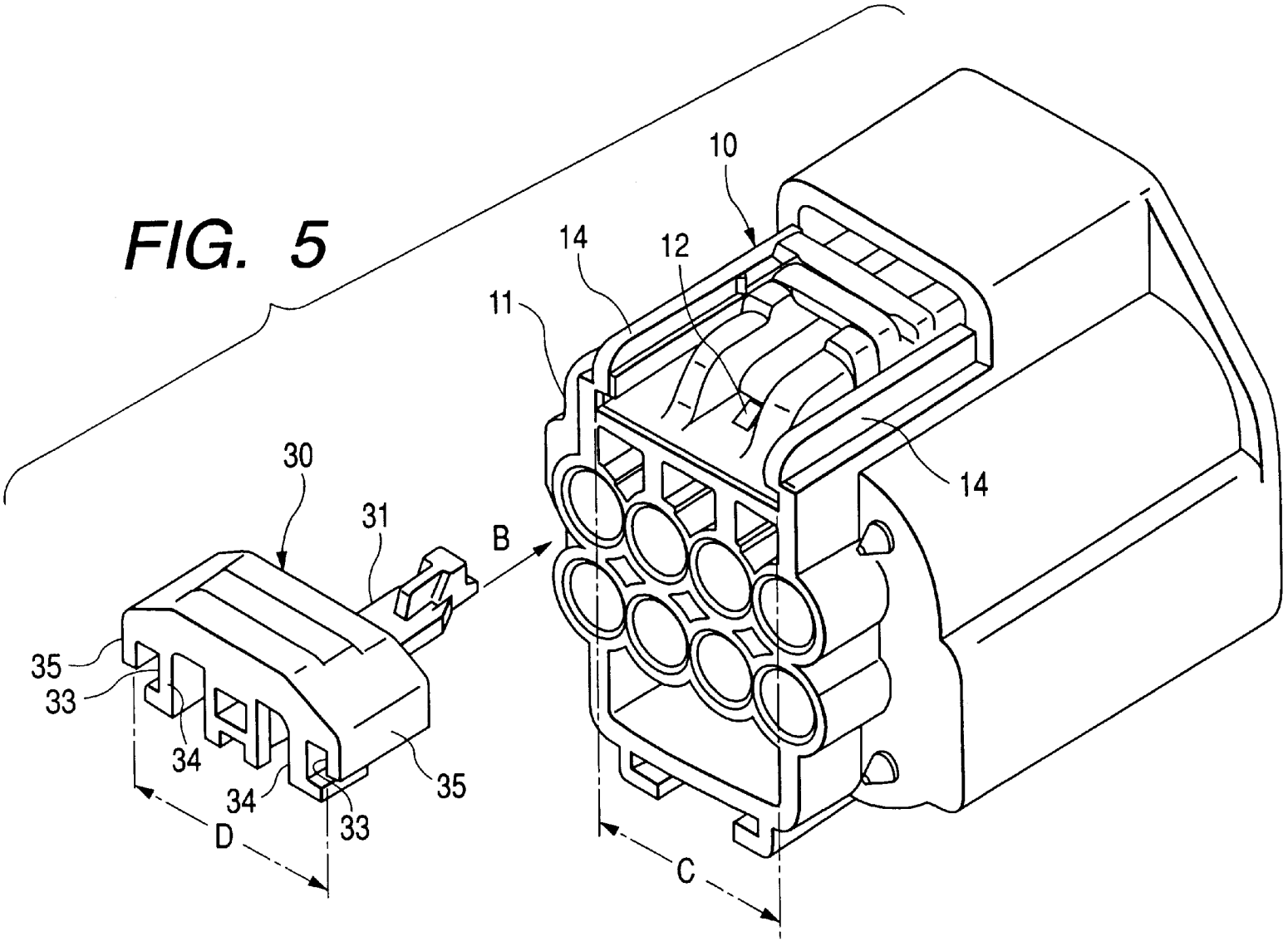
FIG. 5 is a perspective view showing a double lock for connectors, which is a fist embodiment according to the invention.
Figure 6:
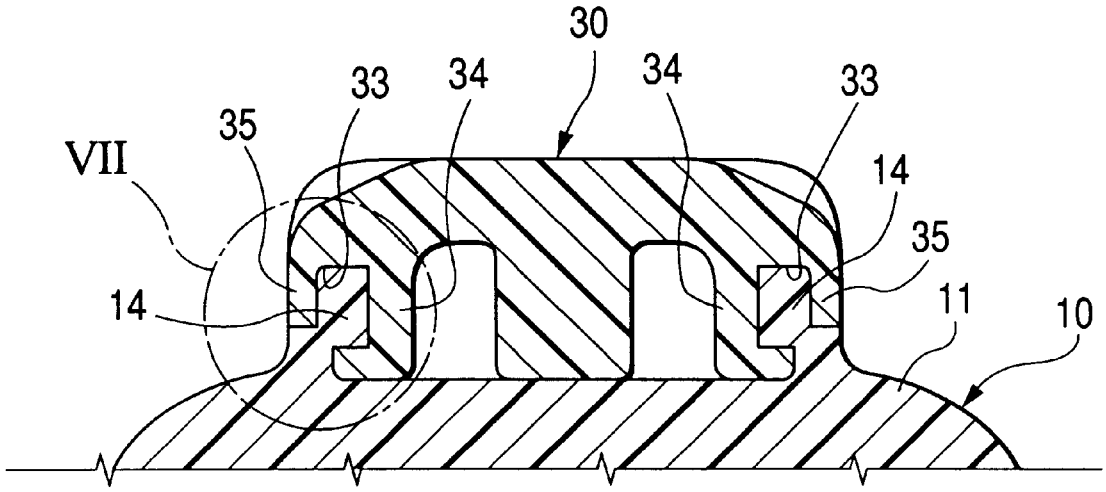
FIG. 6 is a sectional view partially showing a double lock member and a female connector housing of the double lock for connectors of FIG. 5.
Figure 7:
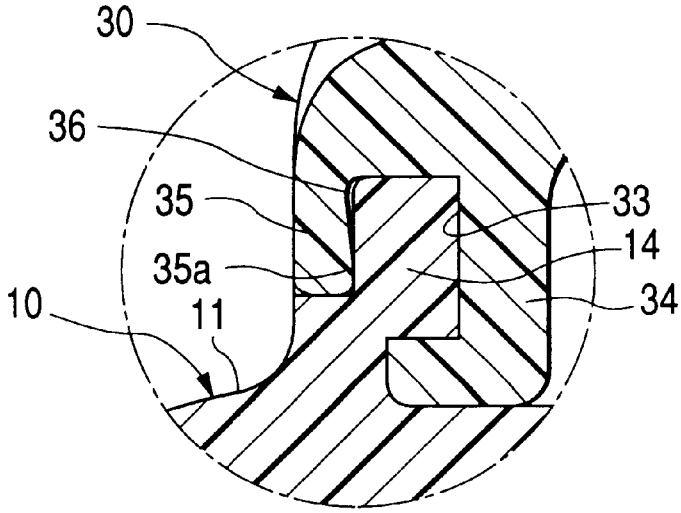
FIG. 7 is an enlarged sectional view of part VII of FIG. 6.

2) As shown in FIG. 4, when the double lock member 52 is inserted to be regularly retained with the female connector housing 53 after the male connector 50 has been engaged with the female connector 51, there is a possibility such that the double lock member 52 is positioned obliquely with respect to the connector housings. Due to the oblique posture of the double lock member 52, the double lock member 52 may not be regularly retained, and further, smooth operation may not be performed.

3) Noise or the like may be produced after the double-locked connectors have been assembled to a motor vehicle.

In view of the above, the following first and second embodiments of the invention will now be described with reference to FIGS. 5 to 11.

First Embodiment

As shown in FIGS. 5 to 10, a double lock member 30 is engaged with a female connector housing 11 in a predetermined direction (in the direction indicated by the arrow B in FIG. 5) while allowing guide ribs 14 of a female connector 10 to be inserted into guide grooves 33 thereof.

Figure 8:
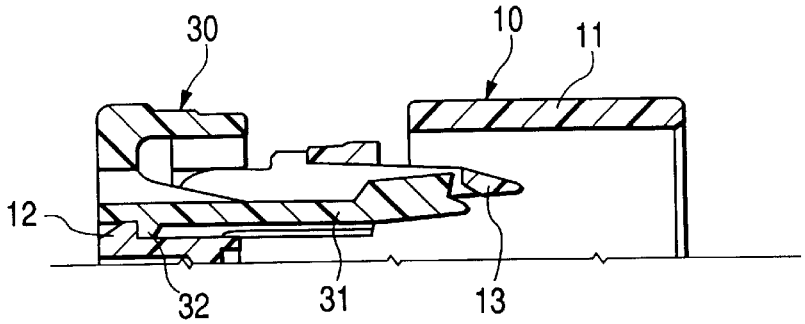
FIG. 8 is a sectional view showing a condition in which the double lock member is temporarily retained with the female connector housing.
Figure 9:
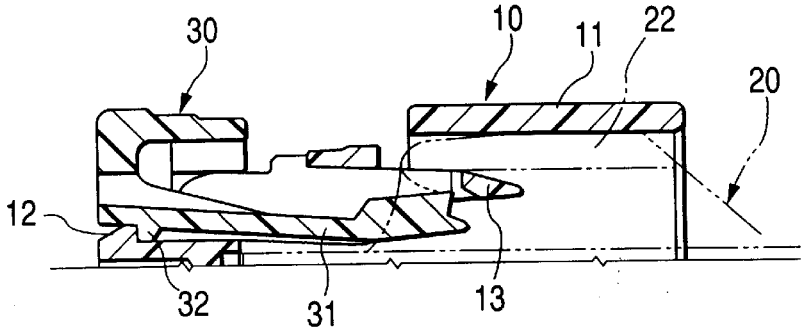
FIG. 9 is a sectional view showing a condition in which a male connector is engaged with a female connector from the condition shown in FIG. 8.
Figure 10:
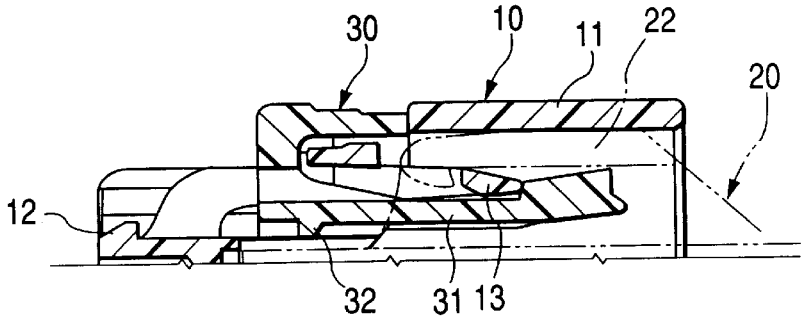
FIG. 10 is a sectional view showing a condition in which the double lock member is regularly retained with the female connector housing from the condition shown in FIG. 9.

The double lock member 30 is temporarily retained with the female connector housing 11 as shown in FIG. 8 while engaged with the female connector housing 11 in a predetermined direction. Furthermore, the double lock member 30 is regularly retained with the female connector housing 11 as shown in FIG. 10 under a condition shown in FIG. 9 in which a male connector 20 is engaged with the female connector 10. Accordingly, it is possible for the double lock member 30 to reliably hold the engagement between the male connector 20 and the female connector 10.

More specifically, the double lock member 30 is temporarily retained with the female connector housing 11 while the double lock member 30 is engaged with the female connector housing 11 from the left side as viewed in FIG. 8 so that a retaining catch 32 disposed at the base end portion of a lock arm 31 is retained by a projection 12 disposed on the female connector housing 11. Then, when the male connector 20 is engaged with the female connector 10 from the right side as viewed in FIG. 9, a retaining projection 22 disposed on a male connector housing (not shown) of the male connector 20 is retained by a fitting projection 13 disposed on the female connector housing 11 so as to ride over the fitting projection 13 while flexing the fitting projection 13 downwardly, and further, the front end of the lock arm 31 of the double lock member 30 is pressed downwardly by the retaining projection 22. Further, the double lock member 30 is retained while causing the front end portion of the lock arm 31 thereof to ride over the fitting projection 13 of the female connector housing 11 in association with the pushing operation toward the right as viewed in FIG. 9. Accordingly, the double lock member 30 is regularly retained. In other words, the double lock member 30 is in a double-locked condition.

A pair of guide ribs 14 is disposed on the female connector housing 11 so as to extend along an engaging direction B of a double lock member 30 and so as to be apart from each other by a predetermined distance C in a direction intersecting to such engaging direction B.

A pair of guide grooves 33 is disposed on the double lock member 30 so as to extend along the direction B of engaging the double lock member with the female connector 10 and so as to be apart from each other by a predetermined distance D in a direction intersecting to the engaging direction B. At the time of engaging the double lock member 30 with the female connector housing 11, the respective guide grooves 33 allow the corresponding guide ribs 14 to be inserted thereinto, and enclose substantially all the outer surfaces of the guide ribs 14 by the inner sidewalls 34 and the outer sidewalls 35 thereof. Accordingly, the guide grooves 33 respectively guide the double lock member 30 in such a manner that the double lock member 30 can take a predetermined position with respect to the female connector housing 11.

The distance D between the respective guide grooves 33 and the distance C between the respective guide ribs 14 are set so that the distance C is equal to or greater than the distance D. More specifically, the distance C between the outer side surfaces of the respective guide ribs 14 is set to a value equal to or greater than the distance D between the inner surfaces of the outer sidewalls 35 of the respective guide grooves 33. When the corresponding guide ribs 14 are inserted respectively into the guide grooves 33, predetermined portions 35*a* (the lower end portions as viewed in FIG. 7) of the outer sidewalls 35 of the guide grooves 33 are fitted with the corresponding portions of the outer side surfaces (the left side surfaces as viewed in FIG. 7) of the guide ribs 14, so that predetermined biasing forces to be applied to each other are caused. At this instance, very small gaps 36 are respectively provided between the portions excluding the predetermined portions 35*a* of the outer sidewalls 35 of the respective guide grooves 33 and the outer side surfaces of the respective guide ribs 14.

The operation of the first embodiment according to the invention will be described.

The double lock member 30 is engaged with the female connector housing 11 from the left side as viewed in FIG. 8. Further, the double lock member 30 is temporarily retained with the female connector housing 11 so that the retaining catch 32 of the lock arm 31 is retained by the projection 12 of the female connector housing 11 as shown in FIG. 8. Then, as shown in FIG. 9, the male connector 20 is engaged with the female connector 10 from the right side as viewed in FIG. 9, and when the retaining projection 22 of the male connector housing (not shown) is retained with the female connector housing 11 while riding over the fitting projection 13 of the female connector housing 11 (primary lock), the front end portion of the lock arm 31 (the right end portion as viewed in FIG. 9) of the double lock member 30 pressed downwardly by the retaining projection 22. Furthermore, as shown in FIG. 10, the double lock member 30 is retained by the female connector housing 11 with the front end portion of the lock arm 31 riding over the fitting projection 13 of the female connector housing 11 in association with the pushing operation toward the right as viewed in FIG. 9 (secondary lock). Accordingly, the double lock member 30 is regularly retained with the female connector housing 11, and reliably holds the engagement between the male connector 20 and the female connector 10.

When the double lock member 30 is engaged with the female connector housing 11, the respective guide grooves 33 of the double lock member 30 allow the corresponding guide ribs 14 of the female connector housing 11 to be inserted thereinto. Therefore, the respective guide grooves 33 guide the double lock member 30 in such a manner that the double lock member 30 can take a predetermined position with respect to the female connector housing 11.

Second Embodiment

Figure 11:
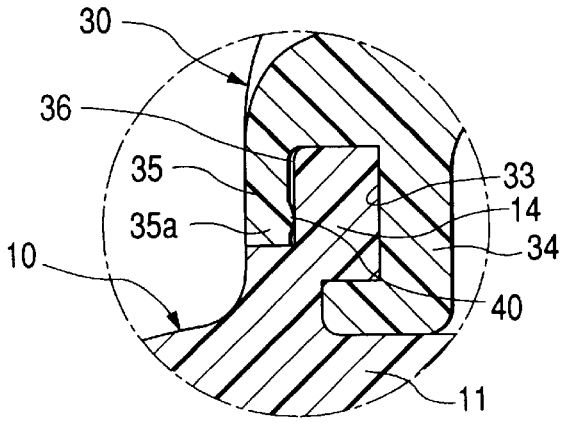
FIG. 11 is an enlarged sectional view partially showing a double lock member and a female connector housing of a double lock for connectors, which is a second embodiment according to the invention.

FIG. 11 is an enlarged sectional view partially showing a double lock member and a female connector housing of a double lock for connectors, which is a second embodiment according to the invention.

In FIG. 11, projections 40 are disposed at the predetermined portions 35*a* of the guide grooves 33, respectively. When the corresponding guide ribs 14 is respectively inserted into the guide grooves 33, the predetermined portions 35*a* of the guide grooves 33 is fitted with the corresponding portions of the guide ribs 14, so that predetermined biasing forces to be applied to each other are caused through the projections 40.

Other constitutional and operational aspects are identical with those of the first embodiment.

According to the aforementioned embodiments as described above, at the time of engaging the double lock member 30 with the female connector housing 11, the respective guide grooves 33 of the double lock member 30 allow the guide ribs 14 of the female connector housing 11 to be inserted thereinto. Accordingly, the guide grooves 33 can guide the double lock member 30 in such a manner that the double lock member 30 can take a predetermined position with respect to the female connector housing 11. Therefore, it is possible to reliably prevent the double lock member 30 from being positioned obliquely with respect to the connector housings at the time of assembling the double lock member 30 to the female connector housing 11.

In addition, the guide grooves 33 are formed so as to enclose substantially all the outer surfaces of the guide ribs 14 with the inner sidewalls 34 and the outer sidewalls 35 thereof, respectively, and further, the distance C between the outer side surfaces of the guide ribs 14 is set to a value equal to or greater than the distance D between the inner surfaces of the outer sidewalls 35 of the guide grooves 33. Therefore, the playing, etc. of the double lock member 30 can be reliably eliminated with satisfactory operability ensured. Accordingly, a cost reduction can be implemented by curtailing the operation time, and the making of noise or the like after the double-locked connectors have been assembled to a motor vehicle can be reliably prevented.

Further, according to the second embodiment, the projections 40 are disposed at the predetermined portions 35*a* of the guide grooves 33, respectively. Therefore, when the predetermined portions 35*a* of the guide grooves 33 allow the corresponding guide ribs 14 to be inserted thereinto, the biasing forces to be applied to each other caused between the guide grooves 33 and the guide ribs can be concentrated on the projections 40 of the guide grooves 33 and the portions of the guide ribs 14 corresponding to the projections 40. Accordingly, the fitting forces between the guide grooves 33 and the guide ribs 14 can be increased without impairing satisfactory operability. Hence, the playing, etc. of the double lock member 30 can be eliminated more reliably.

According to the invention as described in the foregoing, at the time of engaging the double lock member with the female connector, a pair of guide grooves disposed on the double lock member allow a pair of guide ribs disposed on the female connector to be inserted thereinto, respectively, so that the guide grooves guide the double lock member so as to allow the double lock member to take a predetermined position with respect to the female connector. In addition, the guide grooves enclose substantially all the outer surfaces of the guide ribs at the time of allowing the corresponding guide ribs to be inserted thereinto, respectively.

Therefore, the playing, etc., of the double lock member can be prevented reliably, and satisfactory operability during the double lock member assembling operation can be ensured. Accordingly, the making of noise or the like after the double-locked connectors have been assembled can be prevented and a cost reduction can be achieved.

Furthermore, according to the invention as described in the foregoing, at the time of engaging the double lock member with the female connector, a pair of guide grooves disposed on the double lock member allow a pair of guide ribs disposed on the female connector to be inserted thereinto, respectively. Accordingly, the guide grooves guide the double lock member in such a manner that the double lock member can take a predetermined position with respect to the female connector. The distance between the respective guide grooves and the distance between the respective guide ribs are set so that the distance between the guide ribs is equal to or greater than the distance between the guide grooves. As a result of such construction, when the respective guide grooves have allowed the corresponding guide ribs to be inserted thereinto, predetermined portions of the guide grooves get fitted with the corresponding portions of the guide ribs, so that predetermined biasing forces to be applied to each other are caused.

Therefore, the playing, etc., of the double lock member can be prevented reliably, and satisfactory operability during the double lock member assembling operation can be ensured. Accordingly, the making of noise or the like after the double-locked connectors have been assembled to a motor vehicle can be prevented, and a cost reduction can be achieved.

What is claimed is:

1. A double lock for connectors, comprising:

a double lock member temporarily retained while engaged with a first connector in a predetermined direction, the double lock member being regularly retained with the first connector in a condition such that a second connector is engaged with the first connector, so that the double lock member holds the engagement between the second connector and the first connector, a pair of guide ribs disposed on the first connector so as to extend along an engaging direction of the double lock member with the first connector and so as to be apart from each other by a predetermined distance in a direction intersecting to the engaging direction; and a pair of guide grooves disposed on the double lock member so as to extend along an engaging direction of the double lock member with the first connector and so as to be apart from each other by a predetermined distance in a direction intersecting to the engaging direction, wherein the guide grooves respectively have inner sidewalls and outer sidewalls, a distance between outer surfaces of the respective guide ribs is set to a value equal to or greater than a distance between inner surfaces of the outer sidewalls of the respective guide grooves, wherein when the respective guide grooves allow the corresponding guide ribs to be inserted thereinto, predetermined portions of the inner surfaces of the outer sidewalls of the guide grooves are fitted with the corresponding portions of the guide ribs, respectively, so that predetermined biasing forces to be applied to each other are caused, wherein projecting portions are disposed on the predetermined portions of the guide grooves, respectively, and wherein slits are respectively formed by the projecting portions, the outer surfaces of the guide ribs and inner portions of the guide grooves.

2. The double lock for connectors of claim 1, wherein a distance between the respective guide grooves and a distance between the respective guide ribs are set such that the distance between the guide ribs is equal to or greater than the distance between the guide grooves, and wherein when the respective guide grooves allow the corresponding guide ribs to be inserted thereinto, predetermined portions of the guide grooves are fitted with the corresponding portions of the guide ribs, respectively, so that predetermined biasing forces to be applied to each other are caused.

3. The double lock for connectors of claim 2, wherein projecting portions are disposed on the predetermined portions of the guide grooves, respectively.

4. The double lock for connectors of claim 1, wherein gaps are respectively provided between the portions excluding the predetermined portions of the outer sidewalls of the respective guide grooves and the outer surfaces of the respective guide ribs.

5. The double lock for connectors of claim 2, wherein the guide grooves allows the corresponding guide ribs to be inserted thereinto at the time of engaging the double lock member with the first connector, so that the guide grooves guide the double lock member in such a manner that the double lock member takes a predetermined position with respect to the first connector.

6. The double lock for connectors of claim 2, wherein the guide grooves enclosing substantially all outer surfaces of the guide ribs at the time of allowing the corresponding guide ribs to be inserted thereinto, respectively.

7. The double lock for connectors of claim 1, wherein the guide grooves allows the corresponding guide ribs to be inserted thereinto at the time of engaging the double lock member with the first connector, so that the guide grooves guide the double lock member in such a manner that the double lock member takes a predetermined position with respect to the first connector.

8. The double lock for connectors of claim 1, wherein the guide grooves enclosing substantially all outer surfaces of the guide ribs at the time of allowing the corresponding guide ribs to be inserted thereinto, respectively.

* * * * *